US006489579B1

(12) United States Patent
Lo et al.

(10) Patent No.: US 6,489,579 B1
(45) Date of Patent: Dec. 3, 2002

(54) KEY SWITCH

(75) Inventors: Chih Lung Lo, Taipei (TW); Yong Te Tsao, Taipei (TW); Ching-Chiang Yu, Keelung (TW)

(73) Assignee: Behavior Tech Computer Corporation, Taipei (TW)

( * ) Notice: Subject to any disclaimer, the term of this patent is extended or adjusted under 35 U.S.C. 154(b) by 0 days.

(21) Appl. No.: 09/885,925

(22) Filed: Jun. 22, 2001

(51) Int. Cl.[7] ..... H01H 13/70
(52) U.S. Cl. ..... 200/344
(58) Field of Search ..... 200/344, 345, 200/5 A, 517, 341; 400/472, 490, 491.2, 495, 495.1

(56) References Cited

U.S. PATENT DOCUMENTS 5,457,297 A * 10/1995 Chen ..... 200/344
5,829,579 A * 11/1998 Tsai ..... 200/344
5,874,696 A * 2/1999 Hayashi et al. ..... 200/345

* cited by examiner

*Primary Examiner*—Shawn Riley
(74) *Attorney, Agent, or Firm*—Rosenberg, Klein & Lee

(57) ABSTRACT

A key switch, comprising a base unit, a first linking member, a second linking member and a key cap, the first and the second linking members being interactively linked and driven by each other, on two sides of the first and the second linking members being respectively two joining pins, on the base unit and opposite the joining pins of the first and the second linking members being two pairs of connecting units, inside the key cap and opposite the joining pins of the fist and the second linking members being two pairs of connecting units, the connecting units of the base unit and the key cap respectively accommodating the joining pins of the fist and the second linking members, so that all joining pins can slide and move inside the connecting units, and the four joining points can move when the first and the second linking members are moving between the key cap and the base unit, to improve consistency of transmission when the push key is pressed.

1 Claim, 3 Drawing Sheets

KEY SWITCH

BACKGROUND OF THE INVENTION

1. Field of the Invention

The present invention relates to a key switch, in which the joining points can move smoothly when the linking members are moving, to improve consistency of transmission when the key is depressed.

2. Background of the Invention

Conventional design of key switch has been aimed at the consideration of compactness and lightweight. As a result, the linking members acting as transmitting agents from the top to the bottom have been designed in two crossing linking members to reduce the space occupied by the keys. Therefore, the size of a desktop computer keyboard is reduced to become a smaller keyboard for a notebook computer. However, the smaller the specifications of the keys, the less satisfactory the user finds his keyboard is performing when he presses the keys. For instance, when the user has pressed on one corner of the key, instead of accurately and properly pressing the entire key, the transmission of the key is often found not so satisfactory.

BRIEF DESCRIPTION OF THE INVENTION

Therefore, the primary objective of this invention is to provide a key switch, comprising a base unit, interactively linked first and second linking members, and a key cap, on two sides of the first and the second linking members respectively having two joining pins, on the base unit and corresponding to the joining pins of the first and the second linking members being two pairs of connecting units, on the inside of the key cap and corresponding to the joining pins of the first and the second linking members being two pairs of connecting units, so that the four joining points can move inside the connecting units when the first and the second linking members are moving interactively, to improve consistency of transmission when the push key is pressed.

BRIEF DESCRIPTION OF DRAWINGS

The drawings of preferred embodiments of this invention are described in following details to enable better understanding.

DETAILED DESCRIPTION OF PREFERRED EMBODIMENTS

Figure 1:
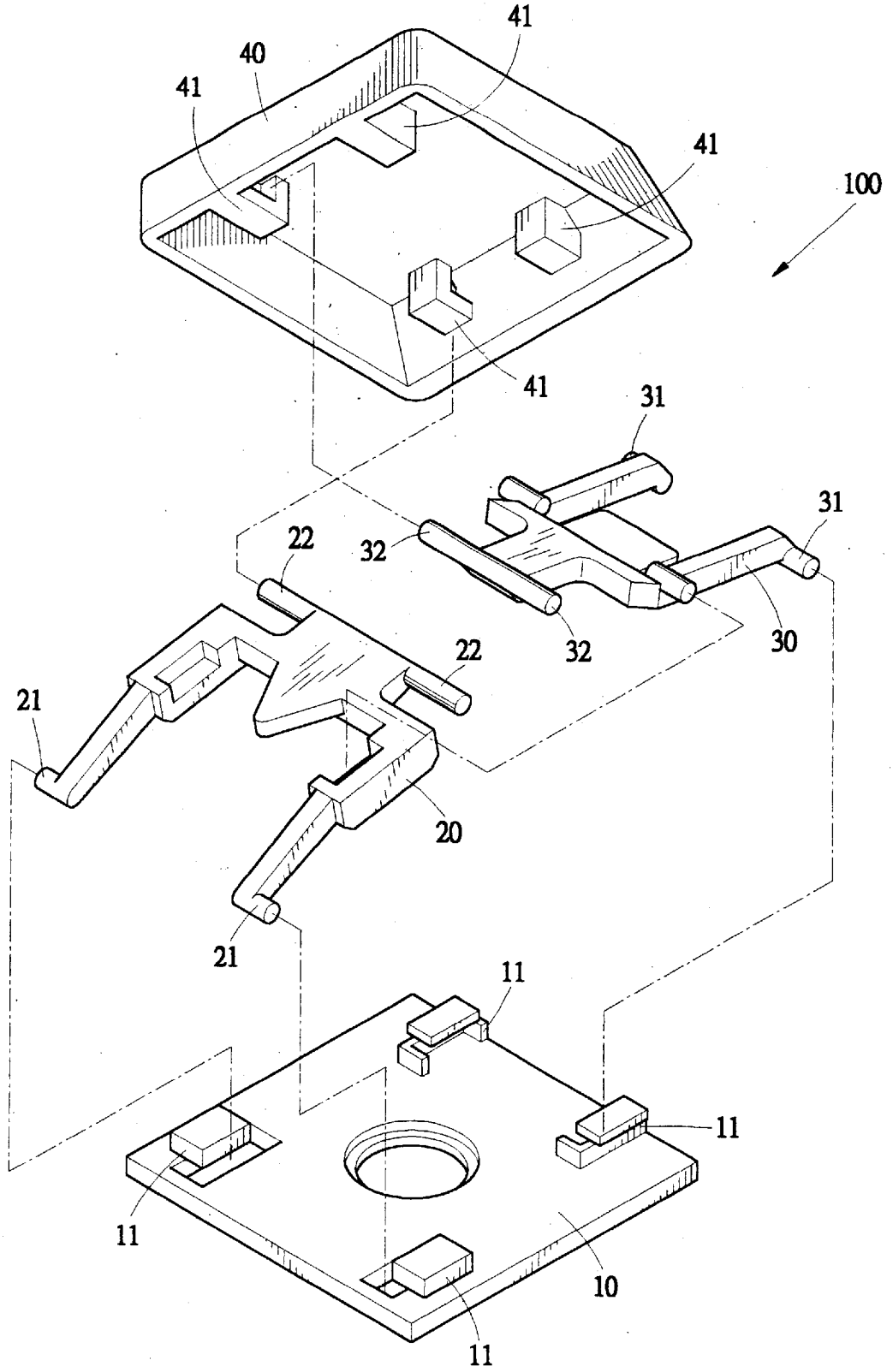
FIG. 1 is an exploded view of the invention of key switch.
Figure 2:
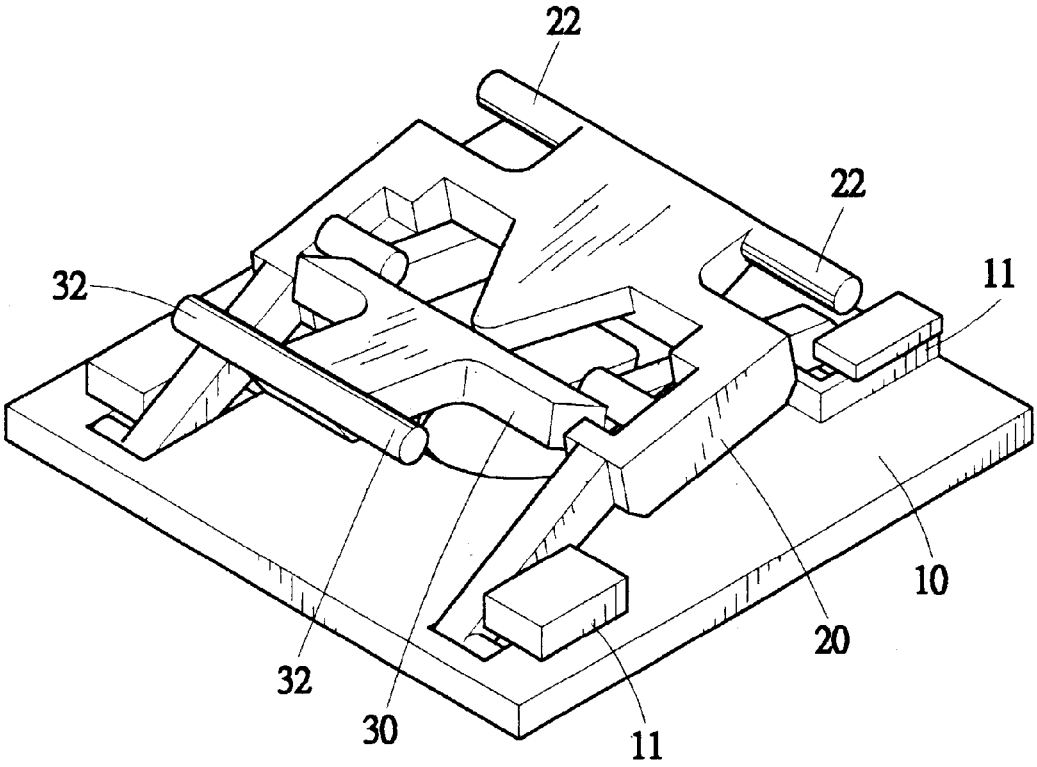
FIG. 2 is a perspective view of the invention, showing the installation of the first and the second linking members on the base unit.

As shown in FIGS. 1 and 2, the invention of key switch 100 comprises a base unit 10, a first linking member 20, a second linking member 30 and a key cap 40. The first and second linking members 20 and 30 are interlinked and inter-driven. On two sides of the first and the second linking members 20 and 30 are respectively formed two joining pins 21, 22 and 31, 32. On the base unit 10 and corresponding to the joining pins 21 and 31 of the first and the second linking members 20 and 30 are two pairs of connecting units 11 and 21. On the inside of the key cap 40 and corresponding to the joining pins 22 and 32 of the first and the second linking members 20 and 30 are two pairs of connecting units 41. The connecting units 11 and 41 of the base unit 10 and the key cap 40 respectively accommodate the joining pins 21, 22 and 31, 32 of the first and the second linking members 20 and 30, enabling the joining pins 21, 22, 31, 32 to move inside the connecting units 11 and 41, and that the four joining points can slide freely when the first and the second linking members 20 and 30 move between the key cap 40 and the base unit 10, and improve consistency when the key switch is depressed.

Figure 3:
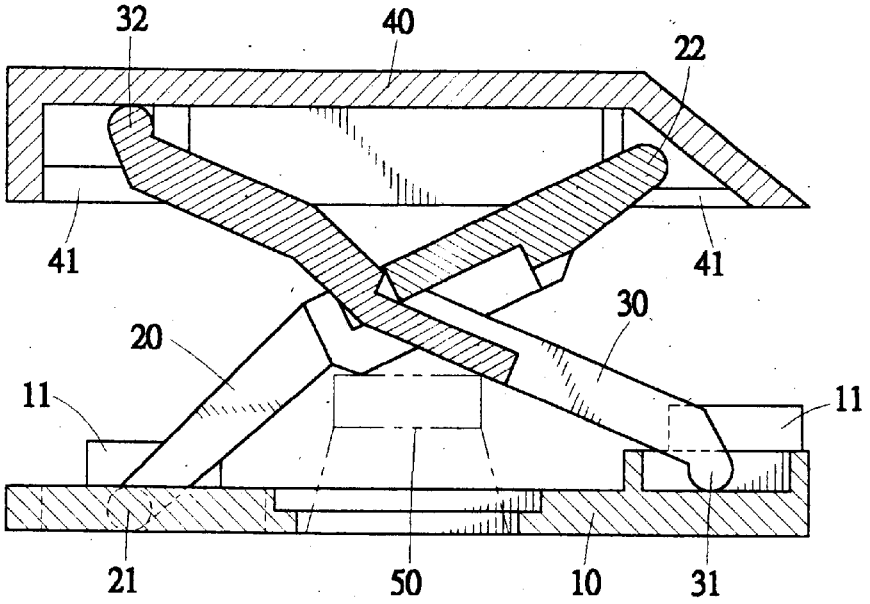
FIG. 3 is a section view of the invention, showing the key switch at a normal position.
Figure 4:
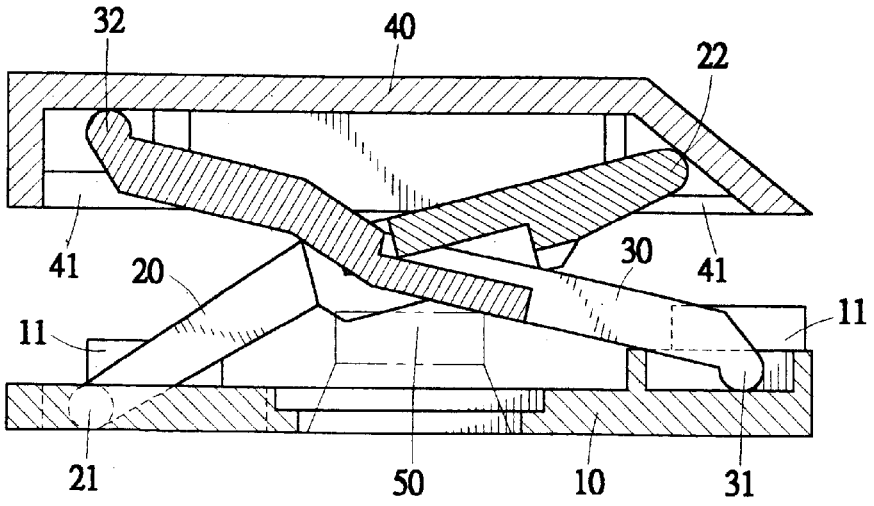
FIG. 4 is a section view of the invention, showing the key switch at a pressed position.

As shown in FIGS. 3 and 4, in the normal position, the joining pins 21, 22 and 31, 32 of the first and the second linking members 20 and 30 are embedded into the connecting units 11 and 41 of the base unit 10 and the key cap 40, close to the inside, while a rubber post 50 built in each key switch 100 of the keyboard presses up the first and the second linking members 20 and 30, maintaining them at their lifted positions, as shown in FIG. 3.

When the key switch 100 is depressed, since the joining pins 21, 22 and 31, 32 can move outwardly inside the connecting units 11 and 41 of the base unit 10 and the key cap 40, allowing the first and the second linking members 20 and 30 to sink and accomplish the pressing performance. Then, even when the key switch 100 is not properly depressed, the position being pressed on top of the key cap 40 is not exact, the first and the second linking members 20 and 30 will interactively link to each other and slide the joining pins 21, 22, 31 and 32, maintaining balanced, downward movement.

What is claimed is:

1. A key switch, comprising a base unit, a first linking member, a second linking member and a key cap, the first and the second linking members being interactively linked and driven by each other, on two sides of the first and the second linking members being respectively two joining pins, on the base unit and opposite the joining pins of the first and the second linking members being two pairs of connecting units, inside the key cap and opposite the joining pins of the fist and the second linking members being two pairs of connecting units, the connecting units of the base unit and the key cap respectively accommodating the joining pins of the first and the second linking members, so that all joining pins slide and move inside the connecting units.

* * * * *